United States Patent [19]

Reynolds et al.

[11] Patent Number: 4,605,019

[45] Date of Patent: Aug. 12, 1986

[54] SPRAYER ATTACHMENT FOR A HAIR DRYER

[75] Inventors: Gordon S. Reynolds, Bountiful; Sherman L. Kendall, Salt Lake City, both of Utah

[73] Assignee: Sorenco, Inc., Salt Lake City, Utah

[21] Appl. No.: 647,717

[22] Filed: Sep. 5, 1984

[51] Int. Cl.[4] ..... A45D 1/00

[52] U.S. Cl. ..... 132/9; 219/370

[58] Field of Search ..... 219/370, 362; 34/91; 132/9, 114

[56] References Cited

U.S. PATENT DOCUMENTS

| | | | |
|---|---|---|---|
| 2,523,912 | 9/1950 | Melchior et al. | 132/9 |
| 3,889,693 | 6/1975 | Tanaka | 139/9 |
| [illegible] | [illegible] | Hamrich et al | 132/9 |
| 3,905,379 | 9/1975 | Churas et al. | 132/9 |
| 3,947,659 | 3/1976 | Ono | 219/362 |
| 3,960,160 | 7/1976 | Hogan | 132/112 |
| 4,114,022 | 9/1978 | Braulke, III | 219/362 |
| 4,166,473 | 9/1979 | Bauer et al. | 132/9 |
| 4,523,080 | 6/1985 | Bolton | 132/9 |

FOREIGN PATENT DOCUMENTS

| | | | |
|---|---|---|---|
| 2095103 | 9/1982 | United Kingdom | 132/9 |

*Primary Examiner*—Robert Peshock

*Attorney, Agent, or Firm*—Workman, Nydegger & Jensen

[57] ABSTRACT

An apparatus which is capable of being removably attached to a conventional, hand-held, electric hair dryer which is also capable of spraying a hair conditioner contained within a standard container such as an aerosol can. In one embodiment of the invention, the device is comprised of two generally cylindrical members. The first cylinder member is designed so that it fits onto the end of the nozzle of a conventional hair dryer. The first cylindrical member is attached to a tubular member which is capable of holding the container. In another embodiment of the device, the tubular member is attached directly to the nozzle of the hair dryer. The tubular member has an opening in its front through which a portion of the spray nozzle of the aerosol cannot pivot or turn because of the close fit of the opening and the spray nozzle. The tubular member or the hair dryer also has attached a trigger which when pulled causes the aerosol can to spray. The spray of the aerosol can then mixes with the hot air exiting the hair dryer so that hair can be dried and a hair conditioner applied simultaneously.

27 Claims, 10 Drawing Figures

SPRAYER ATTACHMENT FOR A HAIR DRYER

BACKGROUND

1. Field of the Invention

The present invention relates to an apparatus which can be attached to a hand-held electric hair dryer so that a hair spray or conditioner can be sprayed onto the hair as it is being dried.

2. The Prior Art

It is presently common practice to dry hair using any one of a number of commercially available electric hand-held hair dryers. This is true both in the case of the professional hair stylist practicing his trade and the individual who routinely used a hair dryer to both dry and groom his hair. It is also common practice for both the professional and the individual to use various hair treatments before, during, or after drying the hair. Indeed, it is often desirable to apply a hair treatment simultaneously with drying the hair. It has been found with respect to some hair treatments that it is critical to control the moisture content of the hair while it is being dried. Particularly when setting hair, it is desirable that the hair dry at a uniform rate and that the hair be left with a moisture content which corresponds to that of the ambient air. This is important so that the hair is not over or under dried, either of which can result in the hair being less than ideally set. As a result, it would be desirable to apply moisture or another type of hair treatment to the portion of the hair requiring such a treatment simultaneously with drying the hair.

Until the development of the present invention, it was difficult to apply a hair conditioner in the correct amounts and at the correct time. Where it would often be desirable to spray a hair treatment onto the hair while drying was taking place, it is now common practice to add the hair treatment either before or after the drying so that the drying and styling of the hair can proceed.

During the drying and styling of the hair it is the usual practice for the stylist, whether he be a professional or an individual styling his own hair, to hold a brush or comb in one hand and the hair dryer in the other hand. Thus, the hair can be brushed into place as it is dried. Obviously, however, the individual performing these tasks has no further physical capacity to perform any additional tasks at the same time, such as the addition of a hair treatment.

In the event that it is desired to apply any type of hair treatment during the drying process, it is necessary for the person doing the drying to interrupt his work and go through a multiple step process. Generally, he must free one hand by putting down the brush or the hair dryer. In the event he puts down the hair dryer he will likely also be required to turn off the dryer. He will then be required to search for and locate the hair treatment or spray needed. Once this is located, it can be applied to the hair as desired and then subsequently replaced to where it is stored. At this point, the brush or dryer must again be located and grasped in order for work to resume. This series of steps is a routine, everyday occurrence, particularly in the case of professional hair stylists.

It would be a great convenience to be able to apply a hair treatment as the hair is being brushed and dried. It is particularly desirable to have the ability to apply a hair treatment without being required to interrupt either the brushing or the drying of the hair. As a result, certain comb and dryer devices have been developed which are also capable of spraying a hair treatment or conditioner or producing steam in order to aid in grooming. None of these devices, however, has been able to satisfactorily solve the problems described herein.

Some devices have been constructed which essentially comprises electric hair dryers with built-in mechanisms capable of spraying hair treatments. These devices use as the basic element of their construction hair dryers similar to those commonly in use. These hair dryers, however, have permanently attached or built into some portion of their bodies a separate mechanism capable of spraying a liquid such as hair treatment. Typically, this type of device employs a reservoir constructed as an integral part of the hair dryer, but separate from the blower mechanism, which is capable of being filled with water or some other type of desired hair treatment. In addition, some devices provide a heating mechanism within the reservoir so that a vapor can be produced.

The reservoir is then fit with a pumping mechanism. This pumping mechanism can generally be activated by repeatedly pressing a knob or lever positioned on the exterior of the reservoir. This in turn forces the liquid out of the reservoir and out a sprayer.

Several problems are apparent with this type of device. One major problem relates to the fact that the reservoir and pumping mechanism is an integral, built-in part of the hair dryer. Thus, a hair dryer must be permanently modified adding greatly to the expense of the hair dryer. In addition, if the water or hair conditioner exits the device through a separate sprayer or nozzle, it is difficult to accurately deliver the liquid to the desired location. The user is simultaneous attempting to direct the hot air from the hair dryer and the hair treatment spray from a separate nozzle. A further problem is that the user must generate the motive force to cause the liquid to spray by repeatedly pumping the knob or lever. The container of hair treatment has no internal means of spraying the liquid.

A variation of the device described above incorporates the reservoir into the handle of the hair dryer. A pumping mechanism is also placed within the handle so that a liquid poured into the handle can be sprayed out. The pumping mechanism is operated by pushing on a plunger or lever positioned on the handle of the hair dryer. Operating the pumping mechanism may cause the liquid to spray out of its own nozzle or the liquid may be sprayed into the path of the hot air leaving the hair dryer. Thus, the force of the air leaving the hair dryer may carry the desired spray.

While the problem of requiring two separate streams to be simultaneously aimed is largely solved using this type of device, several other problems remain. This type of device, like the previous devices, is permanently fit with the reservoir and pumping mechanism. The reservoir cannot be transferred to another hair dryer and such a reservoir and pumping mechanism cannot be easily removed from a hair dryer. Thus, the device lacks a desired measure of flexibility in operation and use. In addition the liquid hair treatment is constantly located in the handle of the device. As the hair dryer is moved, the liquid will be free to slosh about within the handle. This is not only an annoyance, but it makes the dryer more difficult to handle because of the ever shifting weight distribution within the dryer. A further problem with this type of device, as with the devices described above is that the hair treatment must be repeatedly added to the hair dryer. This operation is time consuming and includes a high probability that the liquid will be spilled as it is added.

While it can be seen that the problem of how to spray a liquid onto hair as it is being dried has been long recognized, no device has been developed which adequately deals with the problem. It would be desirable, therefore, to construct a device which could be attached to or detached from an otherwise standard hair dryer which would allow a hair treatment to be sprayed onto hair as the hair is dried. It would also be an improvement if such a device could spray its liquid contents in the same stream as the hot air leaving the hair dryer. This would avoid the problems encountered in simultaneously directing both the air stream and the separate hair treatment stream. In addition, it would be an advancement in the art if commercially available aerosol containers, or other similar types of containers with internal pumping mechanisms and internal means for causing its contents to spray out, could be used in the device. This would avoid the necessity of continually pouring liquid hair treatments into the body of the hair dryer and then being required to pump the liquid out by hand. Such a device is disclosed and claimed herein.

BRIEF SUMMARY AND OBJECTS OF THE INVENTION

The present invention is directed to novel methods and apparatus for applying a hair treatment at the same time the hair is being dried by a conventional, handheld, electric hair dryer. The apparatus of the present invention is attached to a typical hair dryer mechanism so that hair can be dried, brushed and a spray of water, conditioner or other liquid hair treatment can be applied simultaneously. All of these steps can be performed without the need for picking up or putting down equipment or supplies during the drying process. In addition, the liquid hair treatment is mixed with the hot air exiting the hair dryer so that a single stream exists which is easily directed to the desired area.

The device of the current invention is an attachment which is capable of being securely, but removably, mounted on a hair dryer body. In one embodiment, the device is generally comprised of two cylindrical or tubular members. The first cylindrical member is designed so that it fits onto the end of the nozzle of a conventional hair dryer. The interior surface of the first cylindrical member may be slightly tapered or it may contain a series of ribs so that it can be slid onto the nozzle of a hair dryer and secured in place.

The first cylindrical member has a locking tab attached to its outer surface and is generally positioned so that the locking tab is on the underside of the hair dryer nozzle. The locking tab is in turn used to hold a tubular member generally adjacent to the underside of the nozzle of the hair dryer. The locking tab is fit into a slot in the tubular member, thereby securing both members to the hair dryer.

Positioned within the tubular member is an aerosol can or a similar container holding a liquid hair treatment. The novel and unique spray nozzle of the aerosol can extends through an opening in the front of the tubular member. Both the opening and the spray nozzle are configured so that the spray nozzle will not pivot while the can is in place and so that the spray is directed generally upwardly and outwardly into the stream of hot air leaving the hair dryer.

In another embodiment of the device, the nozzle of the hair dryer is configured so that the tubular attachment containing the aerosol can or other container is secured directly to the hair dryer's nozzle. In this embodiment the nozzle of the hair dryer can be of any shape. The nozzle will include, however, a means of attaching the tubular member and apparatus holding the aerosol can. This means may be a track running along the underside of the nozzle which is configured so as to engage and hold the tubular member. Essentially any method of attaching the tubular member to the hair dryer would be acceptable.

The aerosol can is caused to spray by being pressed against the front of the tubular member. This is accomplished by means of a trigger located on or near the handle of the hair dryer when the device is in place. When the trigger is pulled, the aerosol can is pressed against the front of the tubular member which depresses the spray nozzle. A spray of liquid hair treatment then leaves the container and is directed into the stream of air leaving the hair dryer and can be applied to the hair as needed.

It is, therefore, a primary object of the present invention to provide an apparatus which enables a hair treatment to be sprayed onto hair at the same time the hair is being brushed or combed and dried.

It is a related object of the present invention to provide an apparatus which can be removably attached to a conventional hair dryer which is capable of spraying a hair treatment onto hair which is being dried by the hair dryer.

It is a further object of the present invention to provide an apparatus which will spray a hair treatment into the stream of hot air leaving the hair dryer such that the hair treatment will be carried by the hot air stream.

It is still another object of the present invention to provide a method of drying and treating hair which does not entail picking up an putting down equipment and supplies during the drying and treating of the hair.

An additional object of the present invention is to provide an apparatus which is capable of spraying a hair treatment from a conventional aerosol can at the same time the hair is being dried.

These and other objects of the present invention will become more fully apparent from the following detailed description and appended claims, taken in conjunction with the accompanying drawings.

DETAILED DESCRIPTION OF THE PREFERRED EMBODIMENTS

Figure 1:
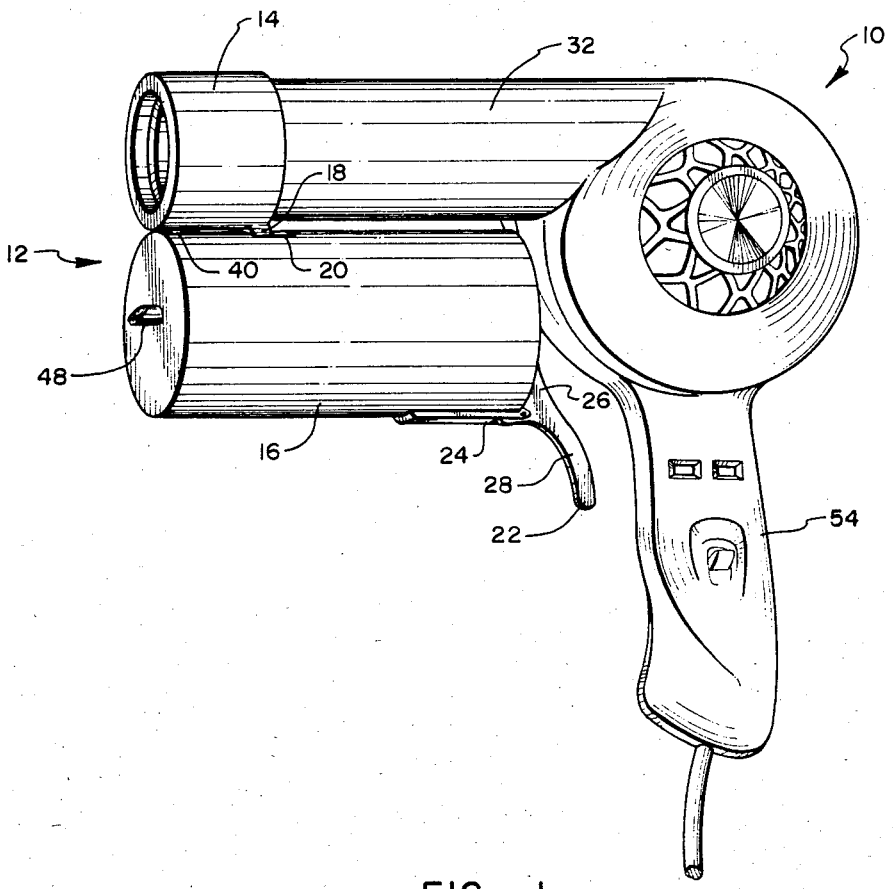
FIG. 1 is a perspective view of the device of the current invention attached to a conventional hair dryer.

The present invention can be best understood by reference to the drawings wherein like parts are designated with like numerals throughout. FIG. 1 is a perspective view which illustrates one embodiment of the device of the current invention attached to an ordinary, commercially available hair dryer. The hair dryer is generally designated 10 and the device of the current invention is generally designated 12. The device of the current invention is an attachment which can be readily added to a hair dryer and which enables the user of the hair dryer to spray a hair treatment onto the hair simultaneously with using the hair dryer to dry the hair.

The two primary parts of the attachment as illustrated in FIG. 1 are a first cylindrical member 14 and a tubular member 16. Extending from the bottom of first cylindrical member 14 is a locking tab 18. This locking tab 18 is designed so that it can fit into a slot 20 in the tubular member 16. The tubular member 16 can then be slid toward the handle of the hair dryer in order to engage locking tab 18. Once locking tab 18 has engaged the tubular member 16, the tubular member 16 his held securely in place until it is intentionally disengaged from first cylindrical member 14.

Additional basic elements of attachment 12 are the trigger 22 and the trigger mount 24. Trigger mount 24 may be permanently secured to the tubular member 16. As an alternative, trigger 22 could be attached directly to the hair dryer. Trigger mount 24, in the embodiment of the device illustrated in FIGS. 1 through 6, will be located on the opposite side and on the opposite end of tubular member 16 from slot 20. Hingably connected to trigger mount 24 will be trigger 22. Trigger 22 is expected to have an upper portion 26 and a lower portion 28. Upper portion 26 is configured so that when pivoted around hinge 30 it will enter the back of tubular member 16 and will have the capability of displacing the aerosol can so positioned within tubular member 16 such that spray nozzle 48 is actuated.

Figure 4:
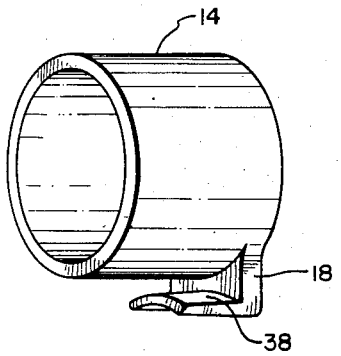
FIG. 4 is a perspective view of the first cylindrical member of the present invention.

As mentioned briefly above, FIG. 1 shows generally the manner in which the attachment 12 can be positioned in order to be used in connection with a conventional hair dryer 10. First cylindrical member 14 is slid onto the nozzle 32 of hair dryer 10. First cylindrical member 14 is designed to fit securely onto the nozzle 32 of a specific size of dryer 10. As illustrated in FIG. 4, first cylindrical member 14 can be constructed with a smooth interior surface which corresponds to the end of the nozzle 32 of the hair dryer 10. Either the interior surface of the first cylindrical member 14 or the exterior surface of the nozzle 32, may be tapered slightly so that once first cylindrical member 14 is slid securely into place it will not easily move in the absence of a relatively strong twisting force.

Figure 5:
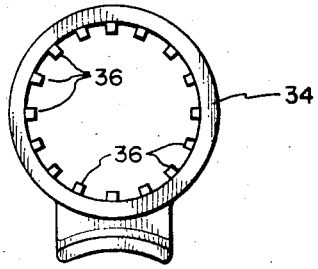
FIG. 5 is a front elevational view of an alternative embodiment of the first cylindrical member of the present invention.

An alternative embodiment 34 of first cylindrical member 14 is illustrated in FIG. 5. First cylindrical member 34 has molded or attached to its interior surface a plurality of ribs 36. Ribs 36, like the interior of first cylindrical member 14 as illustrated in FIG. 4, are constructed in order to enable the attachment of first cylindrical member 34 to the nozzle 32 of the hair dryer 10. The alternative embodiment illustrated in FIG. 5 is attached to and removed from the nozzle 32 in a manner essentially identical to that described above with reference to the embodiment illustrated in FIG. 4. It will be appreciated, however, that first cylindrical members 14 and 34 could be attached to nozzle 32 in any manner which would result in first cylindrical members 14 and 34 being securely attached to the nozzle 32. Possible alternatives includes the use of threads on nozzle 32 and first cylindrical member 14 or a screw which pentrates both.

Either before or after attaching first cylindrical member 14 to nozzle 32, tubular member 16 is attached to first cylindrical member 14. As discussed briefly above, one suitable method of attaching tubular member 16 to first cylindrical member 14 is through the use of locking tab 18 and slot 20. Slot 20 simply comprises an opening of the appropriate size and shape in the body of the tublar member 16. Slot 20 is more fully illustrated in FIGS. 2 and 6. Slot 20 is constructed so as to be able to receive, and allow the tubular member 16 to engage a locking tab 18.

Locking tab 18 is constructed as an integral part of first cylindrical member 14. Locking tab 18 is generally arcuate and corresponds to the curvature of the tubular member 16. As shown in FIG. 4, locking tab 18 also comprises a notch 38. Notch 38 also corresponds to the curvature of the tubular member 16.

Figure 2:
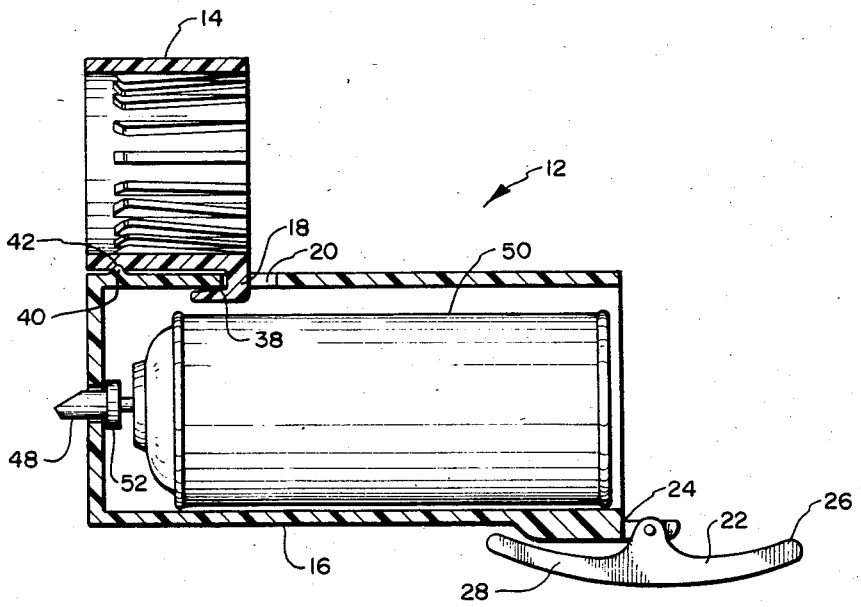
FIG. 2 is a longitudinal cross-sectional view of the device of the current invention illustrating the first cylindrical member and the tubular member attached to one another with an aerosol spray can positioned within the tubular member.

FIG. 2 illustrates first cylindrical member 14 locked in place on top of the tubular member 16. FIG. 2 shows the method of using locking tab 18 and slot 20. Locking tab 18 is lowered into slot 20 and is then pushed forward so that notch 38 engages a portion of the body of the tubular member 16. The two cylindrical members are further kept in an appropriate position with respect to one another by knob 40 on the tubular member 16 and an indentation 42 on first cylindrical member 14. Once engaged as described above, it is very difficult to unintentionally disengage first cylindrical member 14 from the tubular member 16.

It has been found that the use of the slot 20 and locking tab 18 is an effective means of attaching the two members. However, it will be appreciated that a primary function of first cylindrical member 14 is to attach the tubular member 16 to the hair dryer 10. As a result, other means of attachment, including that described below and illustrated in FIGS. 9 and 10, could also be employed. Tubular member 16 could be attached to nozzle 32 by employing an adjustable band which surrounds both the nozzle 32 and tubular member 16 and holds them in the proper position. Nozzle 32 and tubular member 16 could be securely fastened using bolts or screws, however, this would limit somewhat the flexibility now found in the preferred embodiment of the device.

Figure 3:
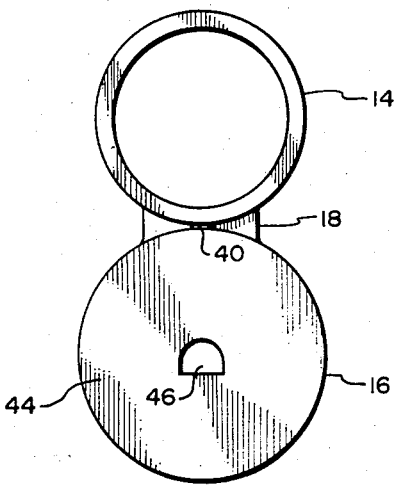
FIG. 3 is a front elevational view of the front end of the device of the current invention.

FIG. 3 further illustrates first cylindrical member 14 and tubular member 16 while they are attached to one another. FIG. 3 is a front elevational view of the device and looks into what would be nozzle 32 of hair dryer 10, were the device attached to hair dryer 10. First cylindrical member 14 and tubular member 16 are shown attached by locking tab 18. In this view, knob 40 can also be seen. FIG. 3 also illustrates in detail the front 44 of tubular member 16. It is presently anticipated that the front 44 will be constructed of the same or similar material as will the remainder of second cylindrical member 16. The front 44 of tubular member 16 will be a disc which is secured onto, or molded as a part of, the end of the tubular member 16. The front 44 will also have an opening 46 into which the spray nozzle 48 of an aerosol can be positioned.

Figure 9:
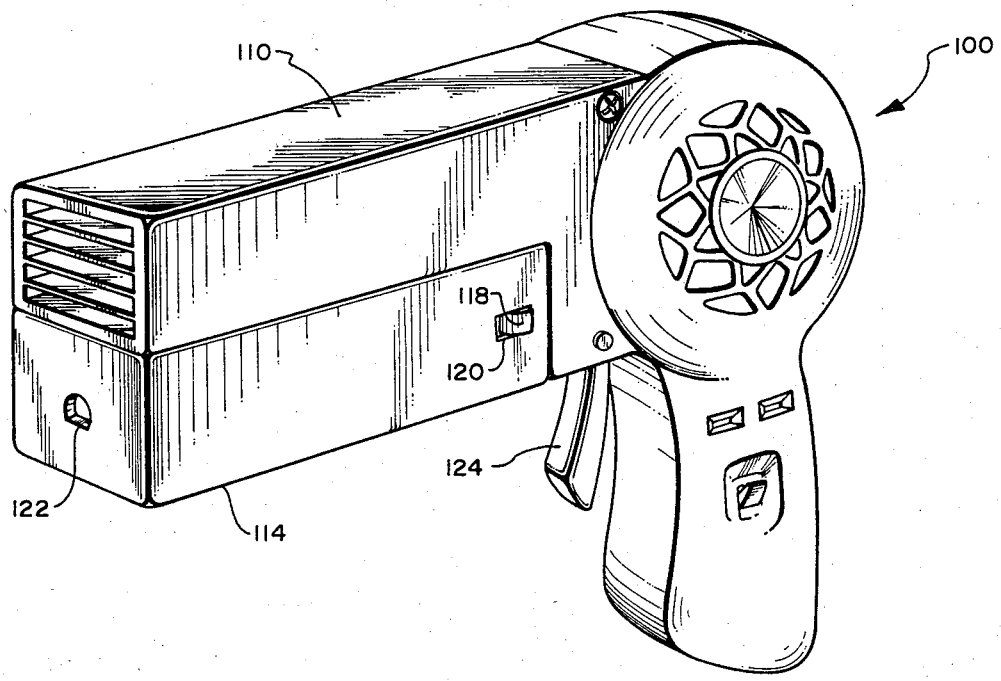
FIG. 9 is a perspective view of one alternative embodiment of the device of the current invention.
Figure 10:
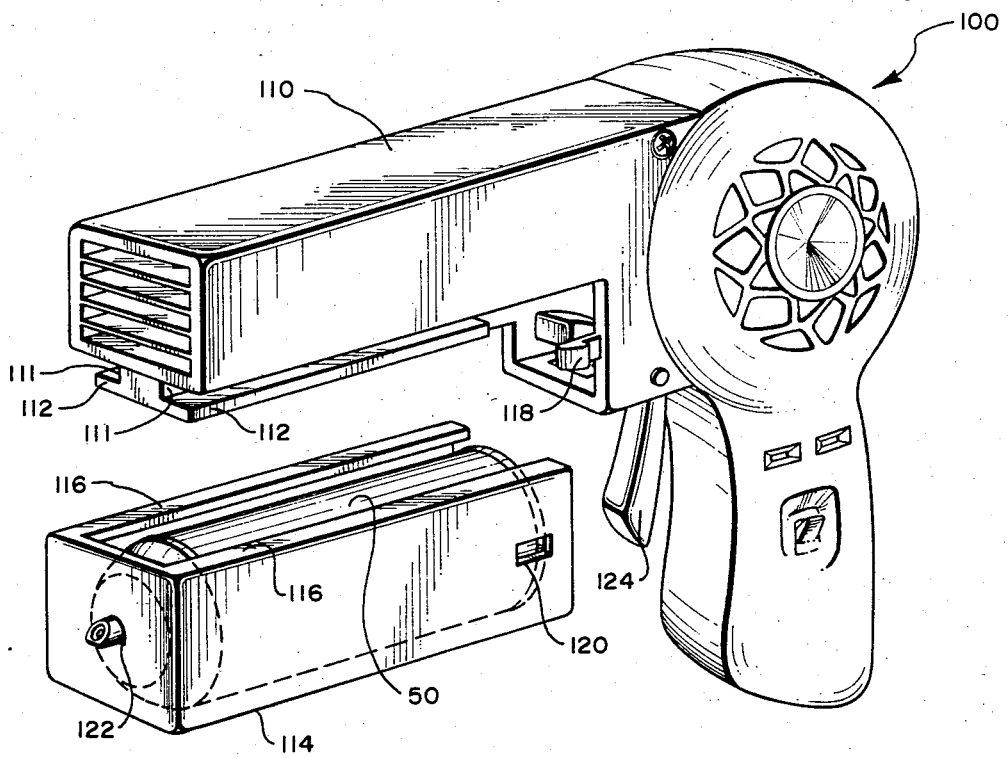
FIG. 10 is a perspective view of the alternative embodiment illustrated in FIG. 9 showing the tubular member detached from the hair dryer and holding an aerosol can.

FIGS. 9 and 10 illustrate an alternative embodiment of the device of the current invention. In this embodiment the first cylindrical member discussed above has been replaced as a means of attachment of the tubular member. FIGS. 9 and 10 illustrate a conventional hair dryer body generally designated 100. Attached to the hair dryer body 100 is a slightly modified nozzle 110. The nozzle 110 illustrated in FIGS. 9 and 10 is generally rectangular in cross-section. It will be appreciated, however, that nozzle 110 could be any of a number of shapes which are in wide use in hair dryers. The rectangular nozzle is used here merely for purposes of illustration.

Attached to the bottom of nozzle 110 is a track 112, as shown in FIG. 10. The track 112 is used as a means for attaching the tubular member 114 to the hair dryer 100. In the embodiment illustrated in FIGS. 9 and 10, the tubular member 114 can slide along the track 112 until it is in the fully locked position illustrated in FIG. 9. In the alternative, it may be possible to construct the track 112 so that it is almost as wide as the underside of the nozzle 110. In such an embodiment, the track 112 will appear as grooves along the underside of the nozzle 110 and it may be possible to simply snap the tubular member 114 into place on the track 112. It will be appreciated that the tubular member 114 will be appropriately configured in order to engage the track 112. Such a configuration may include a pair of strips 116 which engage the grooves 111 in the track 112.

In order to hold the tubular member 114 securely in place it may be desirable to provide a locking tab 118 on the nozzle 110. The locking tab 118 will engage a slot 120 in the tubular member 114. Once the locking tab 118 securely engages the slot 120 in the tubular member 114, it is expected that the tubular member 114 will be held securely in place. In order to disengage the tubular member 114 it is only necessary to depress locking tab 118.

Figure 7:
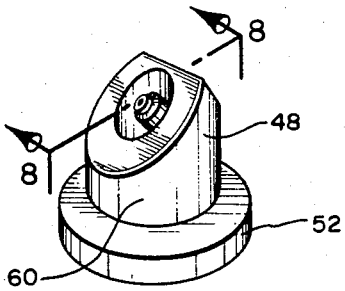
FIG. 7 is a perspective view of the specially configured aerosol spray nozzle.
Figure 8:
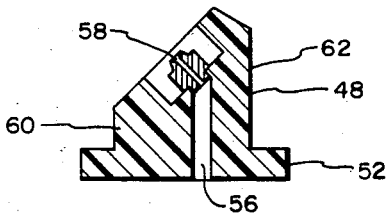
FIG. 8 is a longitudinal cross-sectional view of the spray nozzle along line 8—8 as shown in FIG. 7.

The configuration of opening 46 illustrated in FIG. 3 and opening 122 illustrated in FIGS. 9 and 10 is important to the overall operation of device 12. Openings 46 and 122 should be shaped such that spray nozzle 48 can fit through openings 46 and 122 but such that it will not rotate within the openings. One suitable configuration for openings 46 and 122 is illustrated in FIGS. 3, 9 and 10. Openings 46 and 122 have a generally arcuate shape on one side which joins a generally straight line, thus forming an opening which consists generally of a half-circle. The outside shape of spray nozzle 48 is then formed so that it fits relatively securely within openings 46 or 122. The body 60 of spray nozzle 48 is generally cylindrical having, however, a flat back 62. Thus, spray nozzle 48 when positioned with in opening 46 will not rotate so that the spray from aerosol can 50 will be constantly directed in a predetermined direction. The specific structure of one suitable spray nozzle is illustrated in FIGS. 7 and 8 and will be more fully discussed below.

Figure 6:
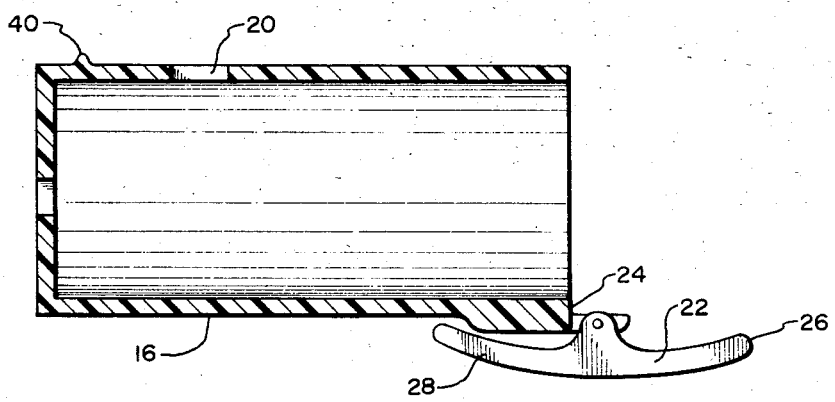
FIG. 6 is a longitudinal cross-sectional view of one embodiment of the tubular member illustrating the trigger of the device positioned such that an aerosol can be slid into said tubular member.

As mentioned above, the tubular member 16 as illustrated in FIGS. 1, 2 and 3 and the tubular member 114 as illustrated in FIGS. 9 and 10 are capable of receiving a container of hair treatment such as an aerosol spray can 50. It is currently anticipated that the size of the tubular members 16 and 114 will enable containers of a standard, commercially available size to be positioned inside. Furthermore, as illustrated in FIG. 6, trigger 22 is free to pivot around hinge 30 so that it does not in any way obstruct the positioning of aerosol can 50 within tubular member 16. In the embodiment illustrated in FIGS. 9 and 10 the trigger 124 is expected to be mounted on the underside of nozzle 110. Thus, there will be no obstruction to loading or unloading an aerosol can. As illustrated in FIG. 2, aerosol can 50 can then be positioned within the tubular member 16 so that spray nozzle 48 extends through opening 46.

The device and each of it parts may be constructed of any appropriate material. It is currently preferred that each part of the device be constructed of a relatively rigid and durable plastic material. It is clear that the device could possibly be constructed of any material ranging from a thin metal sheet to a durable paperboard. A durable plastic, however, has many favorable characteristics such as being relatively light and durable. These features are important in constructing the device so that it will be widely useful and gain acceptance by the professional hair stylist as well as the individual user.

The use and operation of the device 12 illustrated in FIGS. 1 through 6 can be best understood with reference to FIG. 2. FIG. 2 shows first cylindrical member 14 attached through the use of locking tab 18 and slot 20 to the tubular member 16. Positioned appropriately within the tubular member 16 is an aerosol can 50. The spray nozzle 48 of the can extends through opening 46. However, spray nozzle 48 also comprises a somewhat larger base 52 which is larger than opening 46 so that spray nozzle 48 cannot move completely through opening 46. Upper portion 26 of trigger 22 is then pivoted upwardly until it rests against the bottom of aerosol can 50. The device is then ready to be used.

The device 12 is secured to the nozzle 32 of hair dryer 10 such that trigger 22 can be easily accessed with the hand which is holding the handle 54 of hair dryer 10. When the lower portion 28 of trigger 22 is pulled toward the hair dryer handle 54, the upper portion 26 of the trigger 22 pivots into the interior of second cylindrical member 16. Thus, upper portion 26 of trigger 22 will push the aerosol can 50 further into second cylindrical member 16. Since spray nozzle 48 is locked in place by the configuration of opening 46 and base 52, the space between the aerosol can 50 and the spray nozzle 48 will be compressed, eventually causing a spray to exit the aerosol can 50 via the spray nozzle 48. It will be appreciated that by employing an aerosol can the necessity of repeatedly pumping the trigger can be avoided.

The embodiment of the device illustrated in FIGS. 9 and 10 is similar in operation to the embodiment shown in FIGS. 1 through 6. An aerosol can 50 is positioned within the tubular member 114. Again, the spray nozzle 48 of the can is slid through the opening 122. As with the other embodiment, the spray nozzle 48 will be held in place by its unique configuration.

Once the spray can is in place within tubular member 114, tubular member 114 is ready for attachment to the nozzle 110 of the hair dryer 100. As discussed above, the strips 116 are placed so that they engage the track 112 of the nozzle 110. The tubular member 114 is then slid into place until locking tab 118 engages opening 122 and the tubular member 114 is locked in place.

The operation of the device once it is in place is essentially identical to the operation of the first embodiment. Once tubular member 114 is secured on nozzle 110, trigger 124 is in a position to push aerosol can 50 when it is pulled. This in turn forces the aerosol can 50 against the front of tubular member 114 causing the can to spray.

The position and design of the spray nozzle 48 will cause the spray to travel upwardly at roughtly a 45° angle with respect to any hot air which may be leaving the hair dryer 10 or 100. Once the spray enters the path of the hot air leaving the hair dryer 10 or 100 it mixes with and is carried along by the hot air. The end result is that a hair spray can be applied at the same time the hair is being dried requiring only a very simple physical maneuver. This maneuver involves only pulling back on trigger 22 or 124 using one finger of the same hand which is holding the hair dryer 10 or 100. There is no need to put down the hair dryer or to free the other hand in order to apply a hair spray.

As discussed briefly above, one of the unique features of the present invention is the design of spray nozzle 48. The unique design of spray nozzle 48 is illustrated in FIGS. 7 and 8. Spray nozzle 48 performs several important functions in the operation of the device. One of these functions is to remain securely in place and to avoid pivoting. Thus, as discussed above, the shape of the spray nozzle 48 is such that it corresponds to the shape of opening 46 or 122. As a result, once in place spray nozzle 48 has no space in which to move and because of its shape cannot pivot or turn within opening 46 or 122.

Another important function of spray nozzle 48 is to direct the flow of the hair spray in the desired direction. As mentioned above, it has been found that if the spray travels upwardly out of the aerosol can 50 at an approximately 45 degree angle, the spray mixes appropriately with the hot air leaving the hair dryer 10 or 100. FIG. 8 illustrates the configuration of the spray nozzle 48 which allows the spray to be properly directed. Within the spray nozzle 48 is a hollow channel 56. This channel assures that the hair spray will leave the aerosol can 50 at the appropriate angle. In addition, a fitting 58 is positioned within channel 56 so that the spray exiting spray nozzle 48 is of the desired consistency.

As a result, the present invention contains an effective method and device for applying a hair spray at the same time the hair is being dried and brushed. This is accomplished through the use of an inexpensive device which can be removably attached to a conventional hair dryer. There is no need to build a totally separate hair dryer which incorporates reservoirs, pumps and sprayers and which is as a result expensive, difficult to manufacture and cumbersome. The device of the present invention employs the hot air leaving the hair dryer 10 or 100 to carry the hair spray. This makes the application of hair spray simple because it is only necessary to aim a single stream containing both hair spray and hot air, rather than two separate streams. Finally, the hair spray can be applied by simply pulling a trigger 22 or 124 which is conveniently located near the handle of the hair dryer.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalence of the claims are to be embraced within their scope.

What is claimed and desired to be secured by United States Letters Patent is:

1. An apparatus which is capable of being attached to a hair dryer, the hair dryer having a nozzle which conveys a stream of air which leaves the hair dryer through the nozzle, which apparatus is also capable of spraying a hair conditioner, comprising:

means for holding a container of hair treatment, said container having means for spraying hair treatment;

means for causing the container to spray hair treatment at desired intervals;

means for directing the spray of hair treatment in a predetermined direction such that the spray is mixed with the stream of air leaving the nozzle of the hair dryer at a point downstream from the end of the nozzle of the hair dryer and such that the air stream and the spray of hair treatment combine to form a single stream;

means for removably attaching the apparatus to a hair dryer.

2. An apparatus as defined in claim 1 wherein said means for removably attaching the apparatus to a hair dryer comprises a first cylindrical member which is configured so as to fit securely over the end of the nozzle of a hair dryer, which first cylindrical member further comprises means for being securely attached to the remainder of the apparatus.

3. An apparatus as defined in claim 1 wherein said means for removably attaching the appartus to a hair dryer comprises a track having a pair of grooves securely mounted on, and integral with, the nozzle of said hair dryer which track is capable of accepting in locking engagement a pair of strips formed on said apparatus.

4. An apparatus as defined in claim 2 wherein the means for holding a container of hair treatment further comprises a tubular member which forms a portion of the apparatus and which is capable of receiving within its interior said container of hair treatment which tubular member can be attached to the first cylindrical member.

5. An apparatus as defined in claim 4 wherein said means for directing the spray of hair treatment in a predetermined direction comprises an opening in the front of said tubular member into which a spray nozzle attached to the container can be positioned such that the spray nozzle will not pivot or move and such that the spray leaving the spray nozzle will be directed in the predetermined direction.

6. An apparatus as defined in claim 5 wherein said means for causing the container to spray hair treatment at desired intervals comprises a trigger attached to said tubular member which when pulled engages the container of hair treatment at a point distal from the spray nozzle such that the container of hair treatment is forced against the front of said tubular member and in turn activating said container's means for spraying hair treatment.

7. An apparatus as defined in claim 4 wherein said means for securely attaching said first cylindrical member to the remainder of the apparatus comprises a locking tab securely attached to said first cylindrical member which is capable of securely engaging said tubular member.

8. A hair treatment sprayer apparatus which is attachable to a hand-held, electric hair dryer comprising:

an attachment means which is capable of being secured to the nozzle of a hair dryer;

a tubular member capable of removably holding within its interior an aerosol container of hair treatment, said container having means for spraying hair treatment out a spray nozzle;

means for connecting said tubular member to said attachment means;

means incorporated within said apparatus for causing said container to spray at desired intervals; and means incorporated within said apparatus such that the spray from the aerosol can is capable of mixing with air having left the hair dryer, such that a single combined stream of air and hair treatment is formed.

9. An apparatus as defined in claim 8 wherein said attachment means which is capable of being secured to the nozzle of a hair dryer comprises a first cylindrical member configured so that it can be slid into place on the end of the nozzle of the hair dryer.

10. An apparatus as defined in claim 8 wherein said attachment means which is capable of being secured to the nozzle of a hair dryer comprises a track secured to the nozzle of said hair dryer.

11. An apparatus as defined in claim 8 wherein said tubular member is generally cylindrical.

12. An apparatus as defined in claim 10 wherein said tubular member is generally rectangular in cross section and further comprises one or more strips.

13. An apparatus as defined in claim 11 wherein said means of connecting said tubular member to said attachment means comprises a locking tab attached to said first member which can be fit into a slot in said tubular member and which then engages a portion of the body of said second member.

14. An apparatus as defined in claim 12 wherein said means of connecting said tubular member to said attachment means comprises placing said strips of said tubular member such that they can engage said track.

15. An apparatus as defined in claim 8 wherein said means incorporated within said apparatus for causing said container to spray at desired intervals comprises an opening in the front of said tubular member into which the spray nozzle of said container may be placed and a trigger attached near the back of said tubular member which when pulled displaces said container toward the front of said tubular member causing said container to spray.

16. An apparatus as defined in claim 15 further comprising a trigger mount attached near the back of said tubular member.

17. An apparatus as defined in claim 16 wherein said trigger is pivotally attached to said trigger mount.

18. An apparatus as defined in claim 15 wherein said trigger is attached to said tubular member.

19. An apparatus as defined in claim 15 wherein said trigger is attached to said hair dryer.

20. An apparatus as defined in claim 15 wherein said opening in the front of said tubular member is configured such that said spray nozzle fits securely within said opening and is not able to pivot or turn.

21. An apparatus as defined in claim 15 wherein said apparatus is constructed of durable plastic materials.

22. A device for spraying a hair treatment into a stream of air, which stream of air comprises a stream of air having flowed out of a hair dryer comprising:

a hair dryer having a nozzle;

a member attached to the nozzle of the hair dryer which is configured so as to be capable of holding a container of hair treatment; and a spray nozzle configured with respect to said member such that rotation of said spray nozzle is prevented and further configured such that the spray exiting said spray nozzle will intersect the air stream exiting said hair dryer at a point downstream from the end of the hair dryer nozzle.

23. A method of holding a spray nozzle in a desired position comprising the steps of:

(a) obtaining a spray nozzle containing a generally cylindrical body portion having a flat back such that a cross-section of said body portion is generally a semi-circle in shape, said body portion being attached to a disk-shaped base which is larger in diameter than the body portion.

(b) obtaining a sheet of material having an opening corresponding in shape to a cross-section of the body portion and being sufficiently large to allow said body portion to pass through said opening but smaller in diameter than said base;

(c) placing the body portion of said spray nozzle within said opening; and (d) orienting said sheet of material such that said spray nozzle is directed in the desired direction.

24. A method of applying a hair treatment to hair at the same time the hair is being dried, comprising the steps of:

(a) obtaining a conventional electric, hand-held hair dryer;

(b) obtaining a hair treatment sprayer apparatus comprising:

a first cylindrical member which can slide securely over the nozzle of hair dryer;

a second cylindrical member capable of holding within its interior a container of hair treatment, said container having means for spraying hair treatment out a spray nozzle;

means of attaching said first cylindrical member to said second cylindrical member;

means incorporated within said second cylindrical member for causing said container to spray at desired intervals comprising a trigger mechanism;

(c) placing within the interior of said second cylindrical member a container of hair treatment, said container having a means for spraying hair treatment out a spray nozzle attached to said container;

(d) sliding said first cylindrical member onto the nozzle of said hair dryer and positioning said sprayer apparatus such that the spray leaving the container will mix with the hot air produced by the hair dryer after the hot air has left the hair dryer;

(e) turning on said hair dryer and directing the hot air from said hair dryer in the desired direction; and (f) pulling said trigger mechanism as desired in order to spray said hair conditioner.

25. A method for directing a stream of hair conditioner into the air stream exiting the nozzle of a hair dryer comprising the steps of:

obtaining a container of hair treatment, said container having a means for spraying hair treatment out a spray nozzle;

displacing said container so as to actuate the spray nozzle of said container; and directing the spray exiting said spray nozzle so that it intersects the air stream exiting said hair dryer at a location spaced downwstream from the end of the hair dryer nozzle.

26. An apparatus as defined in claim 7 wherein said container of hair treatment comprises an aerosol spray can.

27. An electric hair dryer apparatus comprising:

a hand held electric hair dryer having an air outlet nozzle, means for blowing air out the end of the nozzle, and means for selectively turning said hair dryer on and off;

an aerosol can containing hair treatment and having a spray nozzle;

means for attaching the aerosol can to the nozzle of the hair dryer;

means for spraying hair treatment from the aerosol can at desired intervals;

means for directing the spray of the aerosol can such that hair treatment mixes with air leaving the end of the hair dryer nozzle at a point downstream from the end of the hair dryer nozzle such that the hair treatment and air combine to form a single stream.

* * * * *

UNITED STATES PATENT AND TRADEMARK OFFICE

CERTIFICATE OF CORRECTION

PATENT NO. : 4,605,019

DATED : August 12, 1986

INVENTOR(S) : Gordon S. Reynolds and Sherman L Kendall

It is certified that error appears in the above-identified patent and that said Letters Patent is hereby corrected as shown below:

Abstract, line 14, "aerosol cannot" should be --aerosol can cannot--
Col. 2, line 36, "simultaneous" should be --simultaneously--
Col. 4, line 41, "up an" should be --up and--
Col. 5, line 1, "aerosol can be" should be --aerosol can can be--
Col. 5, line 36, "16 his held" should be --16 is held--
Col. 6, line 16, "includes" should be --include--
Col. 7, line 10, "can be" should be --can can be--
Col. 7, line 63, "with in" should be --within--
Col. 9, line 12, "roughtly" should be --roughly--
Col. 10, line 5, "equivalence" should be --equivalency--
Col. 12, line 39, "of hair dryer;" should be --of a hair dryer;--
Col. 13, line 6, "downwstream" should be --downstream--

Signed and Sealed this

Second Day of December, 1986

*Attest:*

DONALD J. QUIGG

*Attesting Officer*

*Commissioner of Patents and Trademarks*